United States Patent [19]

Hamelink

[11] 4,188,180

[45] Feb. 12, 1980

[54] FUEL BURNER SAFE STARTING SYSTEM

[75] Inventor: William B. Hamelink, Bloomington, Minn.

[73] Assignee: Honeywell Inc., Minneapolis, Minn.

[21] Appl. No.: 856,694

[22] Filed: Dec. 2, 1977

[51] Int. Cl.[2] ..... F23Q 9/08

[52] U.S. Cl. ..... 431/46; 431/42; 431/61; 431/16

[58] Field of Search ..... 431/46, 42, 44, 61, 431/69, 16, 53, 54, 60; 137/66; 251/129, 141

[56] References Cited

U.S. PATENT DOCUMENTS

| | | | |
|---|---|---|---|
| 3,174,535 | 3/1965 | Weber | 431/44 |
| 3,484,177 | 12/1969 | Florio et al. | 431/254 |
| 3,488,131 | 1/1970 | Myers et al. | 431/24 |
| 3,718,423 | 2/1973 | Matthews | 431/264 |
| 3,955,910 | 5/1976 | Matthews | 431/25 |
| 4,073,611 | 2/1978 | Kaduki et al. | 431/54 X |
| 4,077,762 | 3/1978 | Matthews | 431/45 |
| 4,111,640 | 9/1978 | Scott | 431/54 X |

*Primary Examiner*—Samuel Scott
*Assistant Examiner*—Larry Jones
*Attorney, Agent, or Firm*—Alfred N. Feldman

[57] ABSTRACT

A fuel burner safe starting system which utilizes a pilot valve and a main valve is disclosed. A flame detection system operates in conjunction with a relay which properly ignites and operates the fuel burner system. In the event of a failure which improperly energizes the relay, the safe starting system prevents the fuel valves from opening.

9 Claims, 2 Drawing Figures

FUEL BURNER SAFE STARTING SYSTEM

BACKGROUND OF THE INVENTION

Present day fuel burner control technology has moved toward the use of solid state controls and switching devices. Unfortunately, many of the solid state switches and components that are used in the flame detector section of fuel burner systems can fail in an unsafe manner. This unsafe manner normally is in a shorted or conducting mode when the switch element should be nonconductive. There are a number of methods of detecting this type of failure, but these methods normally are rather complex and costly.

SUMMARY OF THE INVENTION

The present invention utilizes a solid state switch in the form of a silicon controlled rectifier in series with a conventional electromagnetic relay. In the event that the solid state switch, whether it be a silicon controlled rectifier or some other form of switch, becomes inoperative in a conductive mode, the relay would be energized. This would be the same as an indication of the presence of flame. A valve means is arranged along with a normally closed contact of the control relay to insure that the system can only open the fuel valve means if no flame is either detected or indicated as present when none should exist. The present invention utilizes a pilot valve that is initially energized by a full wave alternating current voltage. This only occurs when the relay is in the proper "no flame" condition. The opening of the pilot valve then supplies a fuel pressure to the main fuel valve, subsequently (on proving a fire) the relay pulls in and opens the short circuit around the main fuel valve. The combination of the fuel pressure and an energizing potential for the main valve operator allows the main valve to become functional to supply fuel to the fuel burner. At the same time that the short circuit is removed from the main valve operating circuit, the pilot valve operator is placed in series with the main valve operator and is energized from a one-half wave source so that it cannot be pulled in without going through the safe start cycle thereby preventing a defective switch or relay from inadvertently allowing the fuel burner to operate improperly.

DESCRIPTION OF THE PREFERRED EMBODIMENT

Figure 1:
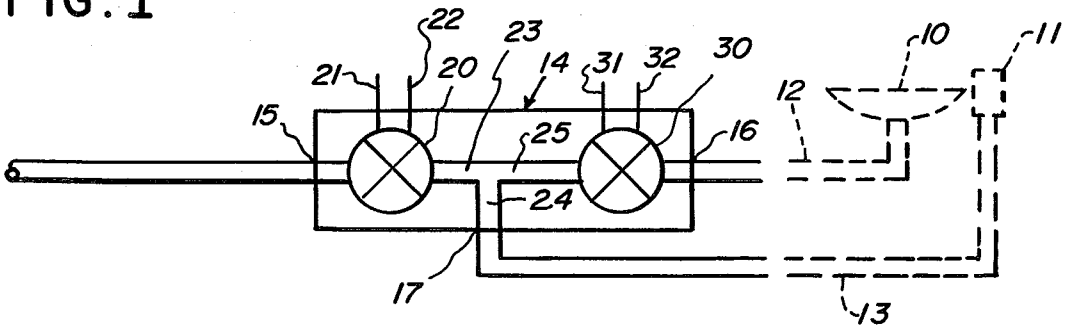
FIG. 1 is a schematic representation of a fuel burner valve means incorporating both a pilot valve and a main valve.

The present invention has utility in a fuel burner system, particularly a system that burns natural or a similar gas. In FIG. 1 a burner is generally disclosed at 10 accompanied by a pilot burner 11 that are adapted to be connected by pipes 12 and 13 to a valve enclosure generally disclosed at 14. The valve enclosure has a fuel inlet 15 and two fuel outlets 16 and 17. The fuel inlet 15 is connected to a pilot valve means 20 that includes a solenoid operator that is connected to a pair of conductors 21 and 22. All of the fuel that enters the inlet 15 flows through the pilot valve means 20 to a conduit 23 that branches at 24 to the pilot line 13 which is connected at the outlet 17. The other branch 25 of the fuel passage 23 flows to a main valve means 30. The main valve means 30 includes a pressure operated or pressure responsive means (not specifically shown) and a solenoid that is connected to the conductors 31 and 32. The main valve means 30 requires a fuel pressure in the conduit 25 as well as electrical energy on the conductors 31 and 32 in order to open the valve means 30 to allow a flow of fuel to the outlet 16 and eventually to the burner 10.

The pilot valve 20 and the main valve 30 along with its pressure operated or pressure responsive means in a single enclosure 14 is known in the valve art. This type of valve, however, is not normally operated in the manner disclosed in connection with FIG. 2 wherein the safe starting system for the fuel burner 10 is disclosed.

Figure 2:
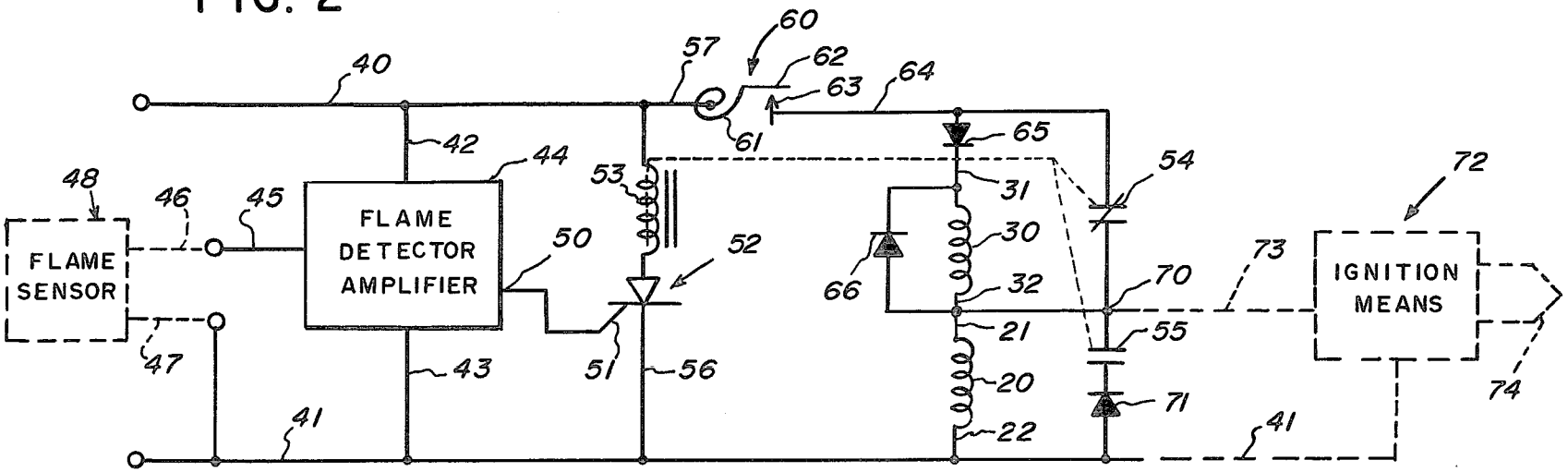
FIG. 2 is a schematic representation of how the valve means would be operated to provide the safe start checking action.

In FIG. 2 a pair of energizing conductors 40 and 41 are shown which supply energy for the entire system. Typically in a fuel burner installation for a residential gas furnace, or similar appliance, the voltage on conductors 40 and 41 would be in the range of 24 volts and would be a full wave alternating current voltage. The voltage on conductors 40 and 41 is supplied by conductors 42 and 43 to a flame detection amplifier means 44. The exact configuration of the flame detector amplifier means 44 is not material to the present invention, but can be any type of system that has an input conductor 45 that is adapted to be connected by a pair of conductors 46 and 47 and is responsive to some type of flame sensing means generally disclosed at 48.

The flame detector amplifier means 44 and the flame sensor means 48 could be an ultraviolet detection system, a visible light detection system, an infrared detection system, a pair of flame rods and amplifier for flame current rectification or any other flame sensor. All of these systems are well known in the art and are not believed to warrant detailed explanations or descriptions. The only material point is that when the flame sensor means 48 detects the presence of a flame, a signal is provided to the flame detector amplifier means 44 and an output conductor 50 is provided with a signal. The conductor 50 is connected to a gate 51 of a silicon controlled rectifier generally disclosed at 52. The anode of the silicon controlled rectifier 52 is connected to a relay 53 that is connected to the conductor 40. The relay 53 has a normally closed relay contact 54 and a normally open relay contact 55. The silicon controlled rectifier 52 further has a conductor 56 that connects its cathode to the conductor 41.

Connected in the line 40 at 57 is a burner demand switch means generally disclosed as 60, and which normally can be thought of as a conventional thermostat. The burner demand switch 60 has been schematically shown as a bimetal operated thermostat 60 with a bimetal 61 and a pair of contacts 62 and 63 to allow for the completion of an electric circuit from the conductor 40 to a further conductor 64. The conductor 64 is connected to an asymmetric current conducting means 65 disclosed specifically as a diode. The diode 65 is connected to the main valve means 30 by the conductors 31 and 32. The conductor 32 is then connected to the pilot valve means 20 by the conductors 21 and 22. It is noted that the diode 65, the main valve means 30, and the pilot valve means 20 are connected in a series circuit from the conductor 64 to the conductor 41. A free-wheeling diode 66 is connected across the main pilot valve means 30 in a conventional fashion. The circuitry is completed by connecting the normally closed relay contact 54 to a common junction 70 which in turn is connected to the normally open relay contact 55. The normally open relay contact 55 is connected to a further diode 71 that provides a free-wheeling action for the pilot valve means 20 when the contact 55 is closed.

The fuel burner system has been shown as completed by an ignition means generally disclosed at 72 and which is energized by a conductor 73 that is adapted to be connected to the junction 70 between the normally closed contact 54 and the normally opened relay contact 55. The conductor 41 is further adapted to be extended to complete an energizing path for the ignition means 72. The ignition means 72 is disclosed as having a spark gap 74 across which a spark would be generated in the vicinity of the pilot 11 of FIG. 1 to ignite the fuel issuing from the pilot. The flame sensor means 48 would be responsive to the flame that exists at the pilot burner 11.

DESCRIPTION OF OPERATION

The general operation of the valve means disclosed in FIG. 1 has already been discussed, but will be briefly mentioned here. The fuel entering the conduit 15 is controlled by a solenoid operated pilot valve means 20 that supplies a fuel pressure to the main valve means 30 along with the pilot fuel to the burner 11. When the fuel pressure is supplied to the main valve means 30, and the main valve means 30 is also electrically energized, it will open to supply fuel to the burner 10 where it will be ignited by the pilot 11 assuming that the pilot 11 has been properly ignited by the ignition means 72. The safe starting of this system is controlled by the circuitry of FIG. 2.

When energy is supplied to the conductors 40 and 41 of FIG. 2, the flame detector amplifier means 44 is operative to sense a flame at the flame sensor means 48. This provides a voltage on the conductor 50 if a flame exists. With the fuel burner demand switch means 60 open, no energy is supplied to either the pilot valve means 20 or the main valve means 30 and, therefore, no fuel is allowed to issue from either the burner 10 or the pilot 11. If the burner demand switch means or thermostat 60 closes, energy is immediately supplied on conductor 64 and through the normally closed relay contact 54 to the pilot valve means 20. This is a full-wave alternating current voltage to which the pilot valve means 20 immediately responds. It will be noted that at this same time power is supplied to the junction 70 so that an energizing potential is adapted to be supplied to the ignition means 72 so that a spark or other ignition source can be provided at the gap 74 to ignite fuel issuing from the pilot 11.

As soon as a pilot flame is established at the pilot 11, the flame sensor means 48 detects the presence of that flame and causes the flame detector amplifier means 44 to provide a voltage on conductor 50 to gate the silicon controlled rectifier 52 into conduction. The conduction of the silicon controlled rectifier 52 provides a current path from the conductor 40 through the relay coil 53 to the conductor 41 thereby energizing the relay 53. The energization of the relay 53 immediately opens the contact 54 and closes the contact 55. As has been previously indicated, the flame sensor means 48 and flame detector amplifier means 44 can be of any type, but in the present case can be considered as a flame rectification sensor with an amplifier that is responsive to a rectified current. This type of an arrangement provides for a very simple and relatively inexpensive means for igniting a pilot burner and fuel burner in an interrupted fashion thereby providing for compliance with the current trend of usage and codes on conservation of fuel.

As soon as the relay 53 has been energized so that the contact 54 opens and the contact 55 closes, the short that the contact 54 has provided around the diode 65 and the main valve means 30 is removed. This allows one-half wave energy to flow through the diode 65 into the main valve 30 and in through the series connected pilot valve 20. The pilot valve means 20 has been designed so that it will pull in on full-wave alternating current and will remain energized on one-half wave alternating current, but will not pull in on the reduced half-wave voltage. This is aided by the closing of the relay contact 55 and the insertion of the diode 71 as a free-wheeling diode across the pilot valve means 20. This also turns off the ignition. The diode 66 acts as a free-wheeling diode for the main valve means 30. As soon as the main valve means 30 is activated, fuel is supplied to the burner 10 and the system is in normal operation.

One of the problems with the use of solid state switching to control burner equipment is the failure of solid state components, possibly in a shorted or rectifying mode. The silicon controlled rectifier 52, if it fails as a short or in a rectifying mode, provides a continuous supply of energy to the relay 53 thereby keeping the relay 53 energized with the contact 54 open circulated, and the contact 55 short circuited. If the system has been in operation and a flame exists no problem is created by this false indication. If the thermostat 60 has opened, the present safety system will prevent the fuel valve from allowing fuel to enter the system in quantities that would be unsafe.

If the thermostat 60 is open and the switch 52 is caused to be conductive because of a failure, the relay 53 will keep the contact 54 open circuited and the contact 55 short circuited. When the thermostat 60 closes and with the contact 54 open circuited, all of the energy for the pilot valve 20 is supplied in series with the main valve means 30 through the diode 65. The pilot valve means 20 has been designed so that it will not initially pull in on this limited half-wave supply of energy. If the pilot valve means 20 cannot pull in, there is no fuel pressure in the conduit 23 (FIG. 1) which is required to activate the pressure responsive means of the main fuel valve means 30 thereby preventing the main fuel valve means 30 from opening. It is thus apparent that any type of failure which causes the relay 53 to be energized at the time the system tries to start, will be sensed, and the pilot valve and main valve cannot operate.

The present arrangement utilizes existing technology in the fuel burner art to provide a fuel burner safe starting arrangement that detects one of the most common types of failures in electronically controlled equipment. A simple arrangement of relay contacts along with the half-wave and full-wave configuration of the series connected pilot valve means and main valve means provides for the necessary safety in various types of fuel burners that are used in many installations, such as in residential furnaces. The present system is a very simple, inexpensive arrangement and has been shown in its very simplest form. It is obvious that variations in the circuitry could be provided which would accomplish the same end and the applicant wishes to be limited in the scope of his invention solely by the scope of the appended claims.

The embodiments of the invention in which an exclusive property or right is claimed are defined as follows:

1. A fuel burner safe starting system, including: flame responsive switch means including a relay having a normally closed contact; said flame responsive switch means adapted to be energized from an alternating current source and to respond to a flame sensor to energize said relay upon said sensor detecting a flame; pilot valve means including coil means with said pilot valve means being capable of opening upon application of a full-wave alternating current voltage to said coil means, and remaining open upon the application of a one-half wave alternating current voltage to said coil means; main valve means including pressure responsive means and coil means with said main valve means being capable of opening upon the joint application of a fuel pressure to said pressure responsive means and a voltage to said main valve coil means; asymmetric current conducting means, said main valve coil means, and said pilot valve coil means forming a series circuit; and burner demand switch means connected to said series circuit and controllably connecting said series circuit across said alternating current source; said normally closed relay contacts connected in parallel with said asymmetric current conducting means and said main valve coil means to initially energize said pilot valve means upon said demand switch means closing thereby starting the operation of said system only upon said relay being initially deenergized.

2. A fuel burner safe starting system as described in claim 1 wherein said flame responsive switch means includes a solid state switch which controls said relay.

3. A fuel burner safe starting system as described in claim 2 wherein said solid state switch is a silicon controlled rectifier; and said burner demand switch means is a thermostat.

4. A fuel burner safe starting system as described in claim 3 wherein said pilot valve means is solenoid operated valve means.

5. A fuel burner safe starting system as described in claim 4 wherein said main valve means includes a solenoid operated valve member.

6. A fuel burner safe starting system as described in claim 5 wherein said pilot valve means and said main valve means are in a common valve enclosure.

7. A fuel burner safe starting system as described in claim 4 wherein said asymmetric current conducting means is a diode.

8. A fuel burner safe starting system as described in claim 7 wherein said relay has a normally open contact and a second diode connected to form a free-wheeling circuit in parallel with said pilot valve solenoid means when said relay is energized to cause said pilot valve means to operate on one-half wave alternating current voltage.

9. A fuel burner safe starting system as described in claim 1 wherein said normally closed relay contact is further adapted to control an ignition means to deenergize the ignition means upon the operation of said relay.

* * * * *